US011571078B2

(12) United States Patent
Sanchez

(10) Patent No.: US 11,571,078 B2
(45) Date of Patent: Feb. 7, 2023

(54) FOOTWEAR REMOVAL DEVICE

(71) Applicant: Esequiel Sanchez, San Francisco, CA (US)

(72) Inventor: Esequiel Sanchez, San Francisco, CA (US)

( * ) Notice: Subject to any disclaimer, the term of this patent is extended or adjusted under 35 U.S.C. 154(b) by 0 days.

(21) Appl. No.: 17/221,495

(22) Filed: Apr. 2, 2021

(65) Prior Publication Data

US 2022/0312889 A1 Oct. 6, 2022

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/82; A47G 25/84; A47G 25/845; A47G 25/86; B43L 7/125
See application file for complete search history.

(56) References Cited

U.S. PATENT DOCUMENTS 8,865 A * 4/1852 Thomson ..... A47G 25/80 223/117
1,210,295 A * 12/1916 Fogelstrom et al. .. A47G 25/80 223/117
1,636,010 A 7/1927 Moland
1,746,537 A * 2/1930 Knechtel ..... B43L 7/12 D10/62
2,439,346 A * 4/1948 Nash ..... B43L 7/125 411/360
3,673,690 A * 7/1972 De Barros ..... G01C 21/20 33/431
3,964,117 A 6/1976 Fox
5,121,861 A 6/1992 Wong
5,385,279 A 1/1995 Dawson
9,038,200 B2 5/2015 McNair
9,167,929 B1 * 10/2015 Henry ..... A47G 25/86
2007/0125813 A1 6/2007 Portuesi et al.
2009/0236377 A1 9/2009 Selvarajah

* cited by examiner

*Primary Examiner* — F Griffin Hall
(74) *Attorney, Agent, or Firm* — Fenwick & West LLP

(57) ABSTRACT

Embodiments relate to a footwear removal device that includes two bases and a bridge connecting that two bases. Each of the bases has a front grip and a rear grip for catching the toe cap and the heel of the footwear, respectively. The bridge coupled to the two bases in a rotatable manner or a removable manner so that the bases and the footwear removable device can be folded or disassembled for carrying or storing. Each of the bases may be a single solid piece or comprise two parts that can be disassembled/assembled to change the overall length of the base. Embodiments provide a simple, inexpensive footwear removal device with a small number of components and are easy to assemble and carry.

10 Claims, 3 Drawing Sheets

FOOTWEAR REMOVAL DEVICE

BACKGROUND

This disclosure relates to a footwear removal device that enables users to conveniently remove their footwears.

Footwears such as shoes, boots, and sandals cover all or part of a person's feet to protect the feet from external environment. Although some footwears are easy to remove, some footwears are difficult to remove. Removal of such footwears may involve force, time and technique. Such problem is exacerbated in young children and elderly people who lack strength or experience limits in their posture. Although conventional footwear removal devices such as boot jacks are available, such devices tend to be bulky and heavy, and/or comprise multiple parts that are difficult to assemble. Hence, conventional footwear removal devices have not gained popularity and wide use.

SUMMARY

Embodiment relate to a footwear removal device that includes a first base, a second base and a bridge connecting the first base and the second base. The first base has a front grip configured to accommodate a front portion of a footwear and a rear grip configured to secure a rear portion of the footwear for removal of a user's foot. The second base is configured to press down the footwear removal device during the removal of the footwear using the first base. The bridge has one end coupled to the first base and the other end coupled to the second base.

In one or more embodiments, the second base has a front grip configured to accommodate a front portion of an opposite footwear of the user's other foot and a rear grip configured to secure a rear portion of the opposite footwear.

In one or more embodiments, the bridge is rotatably coupled to the first base and the second base so that the footwear removal device is foldable.

In one or more embodiments, the first base includes a first piece and a second piece that is movable relative to the first piece to adjust a length of the first base.

In one or more embodiments, the first piece has first teeth and the second piece has second teeth that engage the first teeth at different locations of the second teeth.

In one or more embodiments, the bridge has a thickness that is the same as a thickness of the first base.

In one or more embodiments, the rear grip has an edge facing the front grip and is contoured to match a shape of the rear portion of the footwear.

In one or more embodiments, the front grip, the rear grip and a remaining portion of the first base are integrated into a single body.

In one or more embodiments, the first base or the bridge is made of plastic.

In one or more embodiments, a bottom surface of the first base is indented to accommodate the bridge.

In one or more embodiments, a thickness of the bridge is thinner than a thickness of the first base.

The figures depict embodiments of the present disclosure for purposes of illustration only.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, the described embodiments may be practiced without these specific details. In other instances, well-known methods, procedures, and components have not been described in detail so as not to unnecessarily obscure aspects of the embodiments.

Embodiments relate to a footwear removal device that includes two bases and a bridge connecting that two bases. Each of the bases has a front grip and a rear grip for catching the toe cap and the heel of the footwear, respectively. The bridge coupled to the two bases in a rotatable manner or a removable manner so that the bases and the footwear removable device can be folded or disassembled for carrying or storing. Each of the bases may be a single solid piece or comprise two parts that can be disassembled/assembled to change the overall length of the base. Embodiments provide a simple, inexpensive footwear removal device with a small number of components and are easy to assemble and carry.

Figure 1:
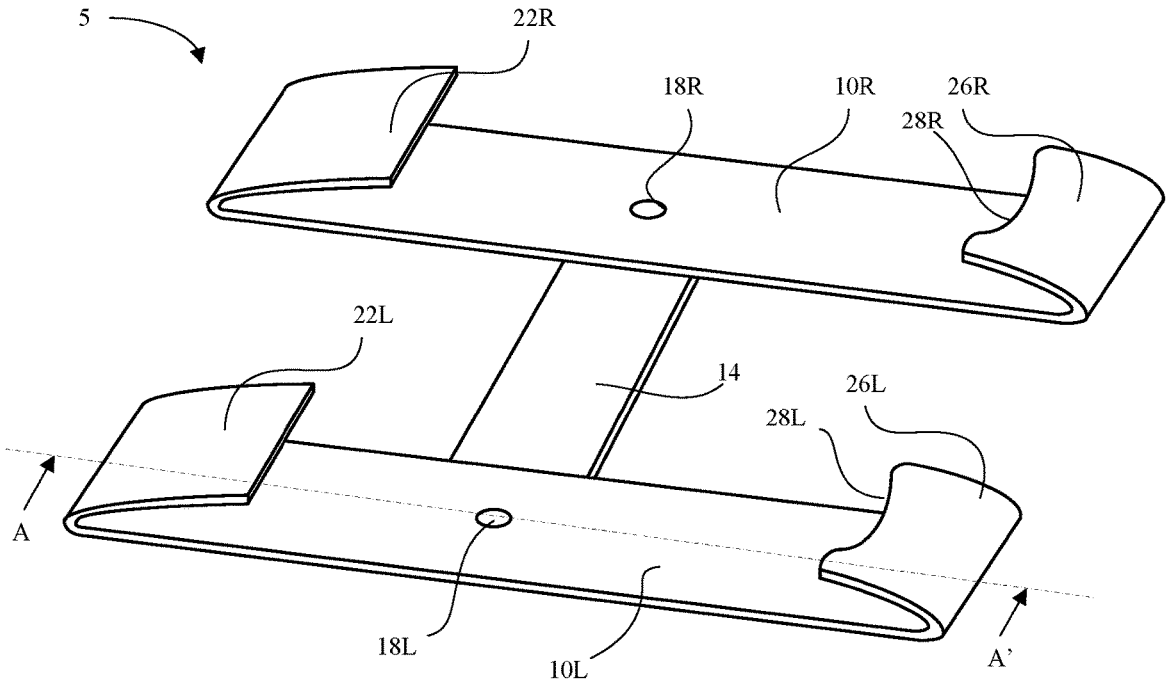
FIG. 1 is a perspective view of a footwear removal device in an expanded state, according to one embodiment.

FIG. 1 is a perspective view of a footwear removal device 5 in an expanded state, according to one embodiment. The footwear removal device 5 may include, among other components, two bases 10L, 10R and a bridge 14 connecting the two bases 10L, 10R. Base 10L is used for removing the left footwear while base 10R is used for removing the right footwear. The footwear removal device 5 may be placed on a floor before use.

Each of the bases 10L, 10R (collectively referred to as "bases 22" or individually also as "base 22") includes a front grip 22L, 22R (collectively referred to as "front grips 22" or individually also as "front grip 22") and a rear grip 26L, 26R (collectively referred to as "rear grips 26" or individually also as "rear grip 26"). The front grip 22 and the rear grip 26 are placed at the front and the rear of the base 10, respectively. In one or more embodiments, the entire base is made of the same material, and can be formed, for example, by a manufacturing process such as injection molding. The front grip 22, the rear grip 26 and the remaining bottom body of the base 10 may be integrated into a single body without removable parts. The bases 10 can be made of, for example, plastic such as High-Density Polyethylene (HDPE).

In one or more embodiments, the front grip 22 is longer than the rear grip 26. The front grip 22 is dimensioned and oriented to catch the front portion (e.g., toe cap) of the footwear between the front grip 22 and the bottom portion of the base 10. The rear grip 26 is dimensioned and oriented to catch the rear portion (e.g., heel) of the footwear. The rear grip 26 may have an edge 28 (also referred to as edges 28L, 28R herein) facing towards the front grip 22. The edge 28 is concaved to match the general shape of a footwear's heel so that the pressure is spread evenly across the footwear's rear portion when the user attempts to remove the footwear.

Figure 4:
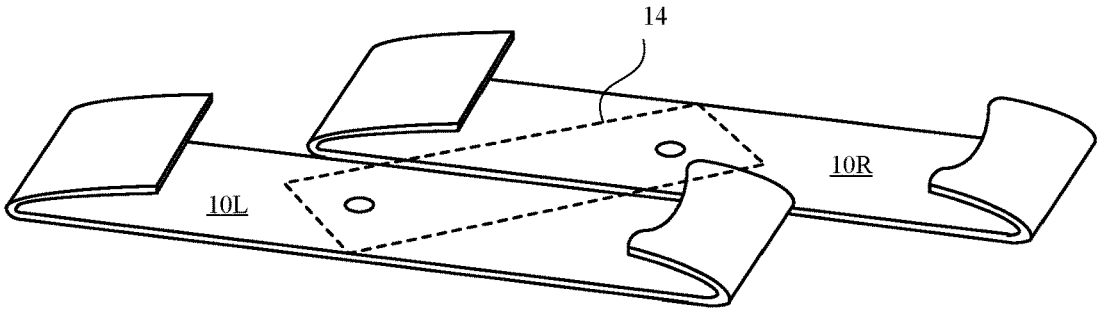
FIG. 4 is a perspective view of the footwear removal device in a folded state, according to one embodiment.

The bridge 14 is a member that connects the two bases 10. The bridge 14 may be made of the same material as the bases 10. The bridge 14 may be a long rectangular shape, and may be coupled between the bases 10 using, for example, screws 18L, 18R (collectively referred to as "screws 18" or individually also as "screw 18"). The bridge 14 has holes 32 at both ends for receiving the screws. The bases 10 may also have holes 34 at the center to receive the screws 18. The screws 18 may be tightened so that the bases 10 and the bridge 14 are firmly fixed. The screws 18 may be loosened or removed to fold the footwear removal device 5 (for example, as shown in FIG. 4) or to disassemble the footwear removal device. Instead of screws, non-removable fixing components such as hinges may be used to secure the bridge 14 and the bases 10. The bridge 14 can be made of, for example, High Density Polyethylene (HDPE).

Although the bridge 14 is illustrated in FIG. 1 as being coupled to center longitudinal locations of the bases 10, the bridge 14 may be coupled to different locations of the bases 10 (e.g., rear or front parts of the bases 10). Moreover, two or more bridges may be used to connect the bases 10.

Figure 2A:
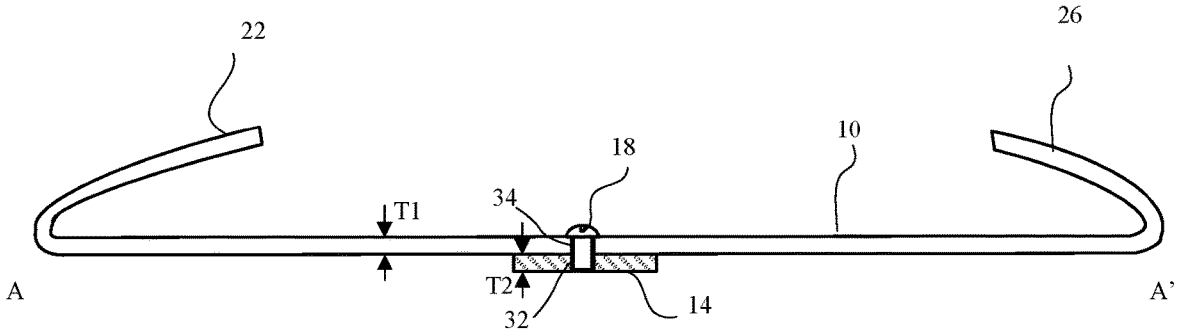
FIGS. 2A and 2B are cross-sectional views of the footwear removal device of FIG. 1, taken along line A-A', according to embodiments.

FIG. 2A is a cross-sectional view of the footwear removal device 5 of FIG. 1, taken along line A-A', according to one embodiment. The bridge 14 is placed below the bottom surface of the base 10 and is connected by the screw 18. For this purpose, the base 10 and the bridge 14 are formed with hole 34 and hole 32, respectively. In the example of FIG. 2A, the thickness T1 of the base 10 is generally the same as the thickness T2 of the bridge 14.

Figure 2B:
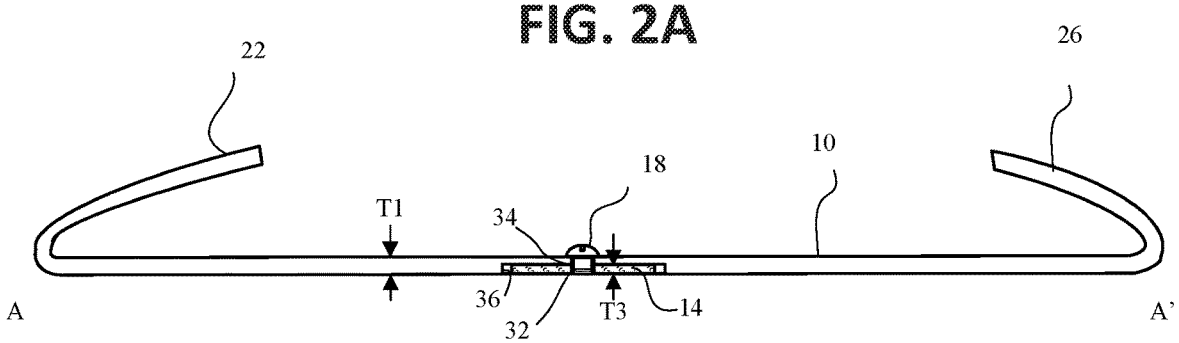

FIG. 2B is s a cross-sectional view of the footwear removal device 5 of FIG. 1, taken along line A-A', according to another embodiment. In the embodiment of FIG. 2B, the base 10 is formed with an indent 36 at its bottom surface so that the bridge 14 can be placed in the indent 36. The bridge 14 also has a thickness T3 that is thinner than the thickness T1 of the base 10. Hence, when the bridge 14 is placed in the indent 36, the bridge 14 does not protrude from the bottom of the base 10 or protrudes to a lesser extent compared to the embodiment of FIG. 2A.

In other embodiments, the bridge 14 may be placed on the top surface of the base 10 rather than beneath the bottom surface of the base 10.

Figure 3A:
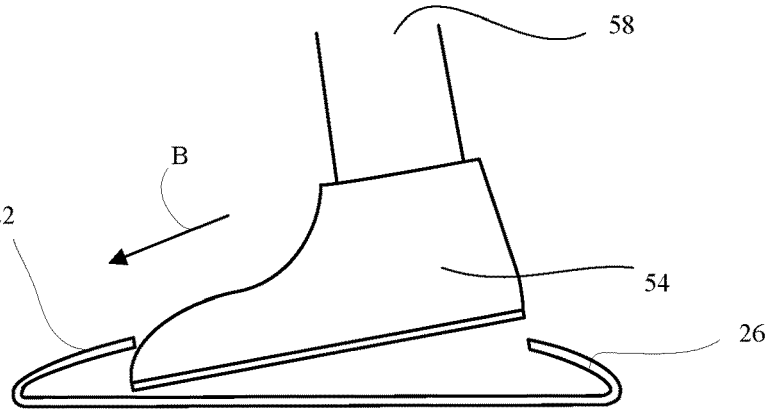
FIGS. 3A through 3C illustrate a process of removing a footwear using the footwear removal device of FIG. 1, according to one embodiment.
Figure 3B:
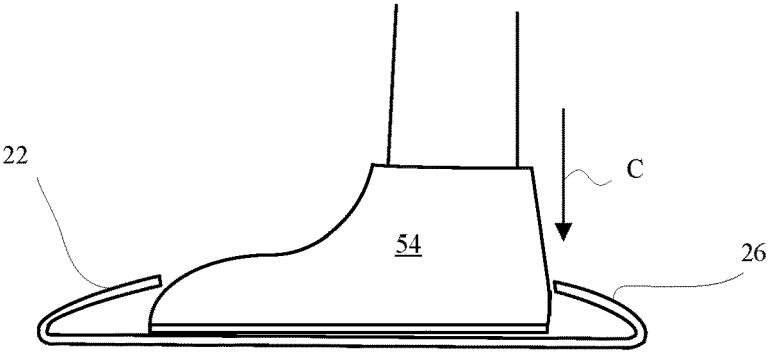
Figure 3C:
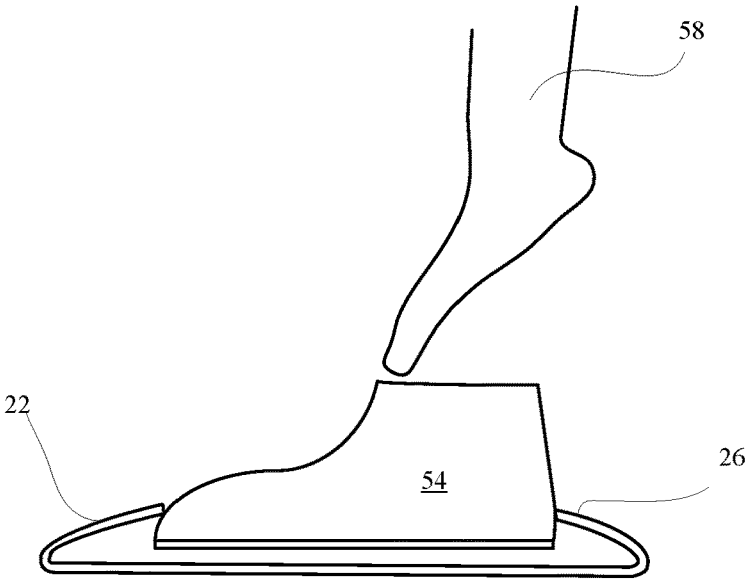

FIGS. 3A through 3C illustrate a process of removing a footwear 54 using the footwear removal device 5 of FIG. 1, according to one embodiment. First, the user inserts the toe cap of the footwear 54 into space between the front grip 22 and the bottom portion of the base 10, by pushing the footwear 54 in a direction indicated by arrow B, as shown in FIG. 3A. During this time, the other footwear or foot of the user may press the other base to prevent moving of the footwear removal device 5. After placing the toe portion beneath the front grip 22, the heel of the footwear 54 is pressed down under the rear grip 26 by moving the heel in a direction indicated by arrow C, as shown in FIG. 3B. Then, the user may remove his or her foot 58 from the footwear 54, by pulling up the foot 58 as shown in FIG. 3C, with the footwear 54 held in place by the front grip 22 and the rear grip 26. To prevent the footwear removing device 5 from moving along with the foot 58, the other base may be pressed down by the other footwear or the foot.

FIG. 4 is a perspective view of the footwear removal device 5 in a folded state, according to one embodiment. After use, the footwear removal device 5 may be folded to save the space for storing or carrying the footwear removal device. To fold the footwear removal device 5, the bridge 14 may be rotated relative to the bases 10 so that the bases come closer or abut each other.

Figure 5:
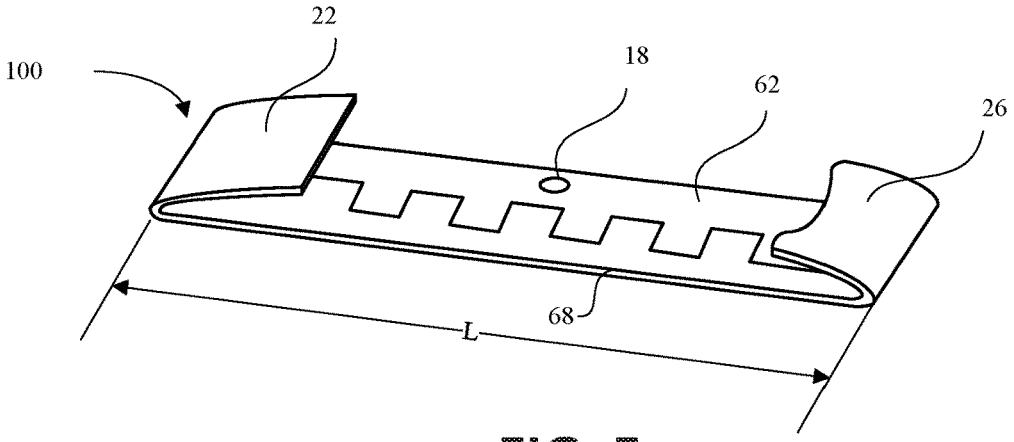
FIG. 5 is a perspective view of an adjustable base in a footwear removal device, according to another embodiment.

FIG. 5 is a perspective view of an adjustable base 100 in a footwear removal device, according to another embodiment. Only one of the base 100 is described with reference to FIG. 5, but the footwear removal device 5 may include another base with a symmetric structure and connected via bridge through a screw 18. To enable adjustment of the length L of the base 100, the base 100 may be formed of two pieces 62, 68 that can be displaced in a longitudinal direction of the base 100.

Figure 6:
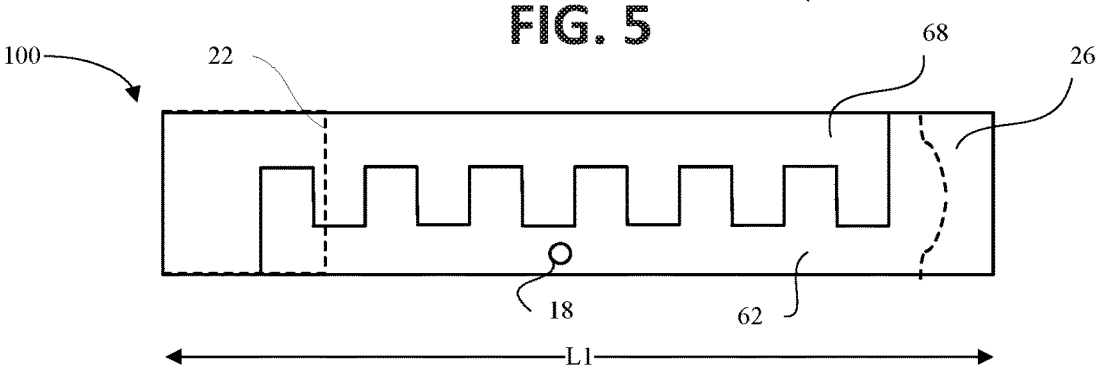
FIG. 6 is a bottom view of the adjustable base of FIG. 5 that is shortened, according to one embodiment.
Figure 7:
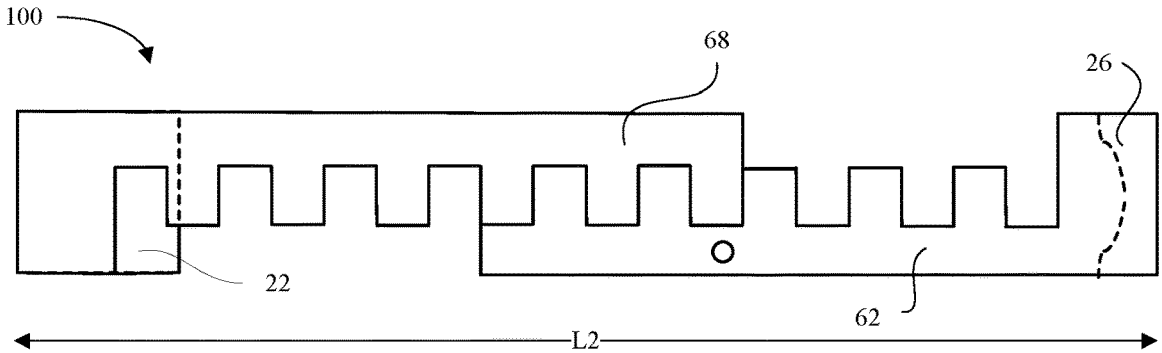
FIG. 7 is a bottom view of the adjustable base of FIG. 5 that is extended, according to one embodiment.

The piece 62 includes the rear grip 26 while the piece 68 includes the front grip 22. In the example of FIG. 5, the pieces 62, 68 have teethed portions that can be adjusted from a shortened state (as shown in FIG. 6) where the length of the base 100 is L1, to an extended state (as shown in FIG. 7) where the length of the base 100 is L2. The pieces 62, 68 can be assembled with different teeth portions engaging each other so that the overall length of the base 100 is adjusted. By adjusting the length of the base 100, the footwear removal device may be used to remove footwears of different sizes.

Although only one extended state is illustrated in FIG. 7, the base 100 can be placed in various extended states with different lengths by adjusting the relative location of the pieces 62, 68 and then locking the teeth of the pieces 62, 68. For this purpose, the pieces 62, 68 may be separated by making vertical relative movement of the pieces 62, 68, moving the pieces 62, 68 longitudinally, and then engaging the teeth of the pieces 62, 68.

Various other structures can be used to enable adjustment of the length of the base 100. Further, other structures such as clamps or screws may be used to lock the pieces of the base 100 once the length of the base 100 is adjusted.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A footwear removal device, comprising:

a first base having a first front grip configured to accommodate a front portion of a footwear and a first rear grip configured to secure a rear portion of the footwear for removal of a user's footwear;

a second base configured to press down the footwear removal device during removal of the footwear using the first base, the second base having a second front grip configured to accommodate a front portion of an opposite footwear of the user and a second rear grip configured to secure a rear portion of the opposite footwear; and a bridge having one end coupled to the first base and another end coupled to the second base, the bridge is rotatably coupled to the first base and the second base, the first base making a relative movement with respect to the second base through rotation of the first base and the second base about the bridge to fold or unfold the footwear removal device.

2. The footwear removal device of claim 1, wherein the first base comprises a first piece and a second piece that is movable relative to the first piece to adjust a length of the first base.

3. The footwear removal device of claim 2, wherein the first piece has first teeth and the second piece has second teeth that engage the first teeth at different locations of the second teeth.

4. The footwear removal device of claim 1, wherein the bridge has a thickness that is the same as a thickness of the first base.

5. The footwear removal device of claim 1, wherein the first rear grip has an edge facing the first front grip and is contoured to match a shape of the rear portion of the footwear.

6. The footwear removal device of claim 1, wherein the first front grip, the first rear grip and a remaining portion of the first base are integrated into a single body.

7. The footwear removal device of claim 6, wherein the first base is made of plastic.

8. The footwear removal device of claim 7, wherein the bridge is made of plastic.

9. The footwear removal device of claim 1, wherein a bottom surface of the first base is indented to accommodate the bridge.

10. The footwear removal device of claim 9, wherein a thickness of the bridge is thinner than a thickness of the first base.

* * * * *